United States Patent [19]

Groothuis et al.

[11] Patent Number: 4,510,687

[45] Date of Patent: Apr. 16, 1985

[54] SHAVING APPARATUS

[75] Inventors: Gerrit J. Groothuis; Atze de Haan; Hendrik Poel; Eduard W. Tietjens; Jochem J. de Vries, all of Drachten, Netherlands

[73] Assignee: U.S. Philips Corporation, New York, N.Y.

[21] Appl. No.: 453,425

[22] Filed: Dec. 27, 1982

[30] Foreign Application Priority Data

Jan. 13, 1982 [NL] Netherlands ..... 8200101

[51] Int. Cl.[3] ..... B26B 19/42

[52] U.S. Cl. ..... 30/34.2; 30/43.92

[58] Field of Search ..... 30/34.2, 346.51, 43.6, 30/43.92

[56] References Cited

U.S. PATENT DOCUMENTS 2,725,625 12/1955 Muntz ..... 30/34.2
3,088,205 5/1963 Ellis ..... 30/43.6
4,150,482 4/1979 Beck ..... 30/346.5
4,258,470 3/1981 Boiten ..... 30/34.2
4,261,101 4/1981 Tietjens ..... 30/43.92

*Primary Examiner*—Jimmy C. Peters
*Attorney, Agent, or Firm*—Rolf E. Schneider

[57] ABSTRACT

There is provided a shaving apparatus comprising a shear plate with hair-entry apertures; and a cutting unit associated with and reciprocatory relative to the shear plate, the cutting unit including a frame. Cutters extend from the frame toward the shear plate, each cutter having a trapezoidal cross section and being in contact along its base with the shear plate. Two hair-pulling blades are respectively associated with and movable relative to the opposite sloping sides of each cutter, each hair-pulling blade normally being in contact with the shear plate. A pair of resilient elements respectively connects the opposite ends of each hair-pulling blade to the frame.

2 Claims, 8 Drawing Figures

SHAVING APPARATUS

This invention relates to a shaving apparatus which comprises a shear plate with hair-entry apertures and a cutting unit which is arranged to be driven with a reciprocatory motion relative to the shear plate and which comprises a frame carrying a plurality of cutters, the cutters being provided with hair-pulling blades which are movable relative to the cutters.

Such a shaving apparatus is known from, for example, U.S. Pat. No. 4,261,101. Since the hair-pulling blades are movable relative to the associated cutters the hair-pulling blades can slightly pull up hairs before these hairs are severed by the cutters. The proper operation of the hair-pulling blades greatly depends on their suspension in the cutting unit.

The present invention aims at improving the construction of the cutting unit in this respect and is characterized in that the hair-pulling blades are each connected to the frame by a resilient element.

In contradistinction to the direct attachment of the hair-pulling blades to the associated cutters, as in the aforesaid known shaving apparatus, the connection of the hair-pulling blades to the frame by resilient elements provides greater freedom as regards the construction of the resilient support for the hair-pulling blades, so that such support can be optimized to obtain the proper operation of the hair-pulling blades by simpler means. Moreover, the invention makes it possible to use constructions which can be manufactured and assembled in a simple manner. These factors have a cost-saving effect on the manufacturing process.

A preferred embodiment of the invention is characterized in that each resilient element comprises an arm which is made of a sheet material and which is integral with the associated hair-pulling blade, which is also made of a sheet material.

An alternative embodiment is characterized in that each resilient element includes a part made of an elastomeric material.

An embodiment comprising a hair-pulling blade on both sides of each cutter is characterized in that the two hair-pulling blades are each connected to the frame by a resilient element.

An embodiment which is very simple to assemble is characterized in that each hair-pulling blade is connected adjacent its ends to the frame by respective resilient elements which comprise arms made of a sheet material, the arms extending transversely of the direction of movement of the cutting unit and being arranged substantially in line with each other, the ends of the arms which are nearer one another being supported on a central portion of the frame while the other end of each arm engages beneath a hook-shaped portion of the frame.

The invention will now be described in more detail with reference to the accompanying drawings, in which.

Figure 1:
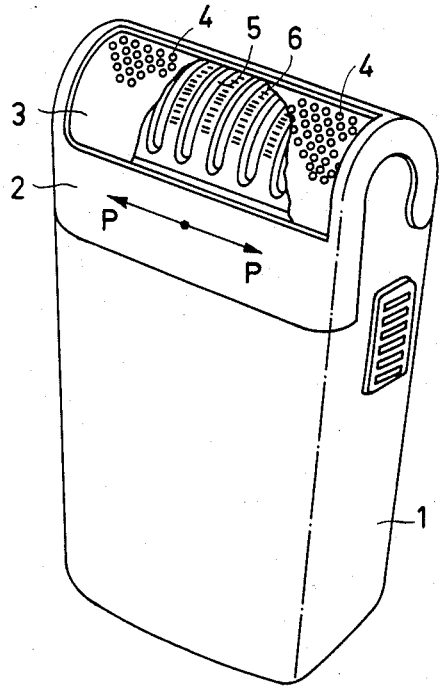
FIG. 1 is a perspective view of a shaving apparatus with the shear plate partly broken away.

The shaving apparatus shown in FIG. 1 comprises a housing 1 having a detachable shaving head 2. The shaving head 2 comprises a shear plate 3 formed with hair-entry apertures 4. At the inner side of the shear plate a cutting unit 5 is adapted, which unit is arranged to be reciprocated in known manner relative to the shear plate 3 as indicated by the arrows P. The cutting unit includes arcuate cutters 6.

Figure 2:
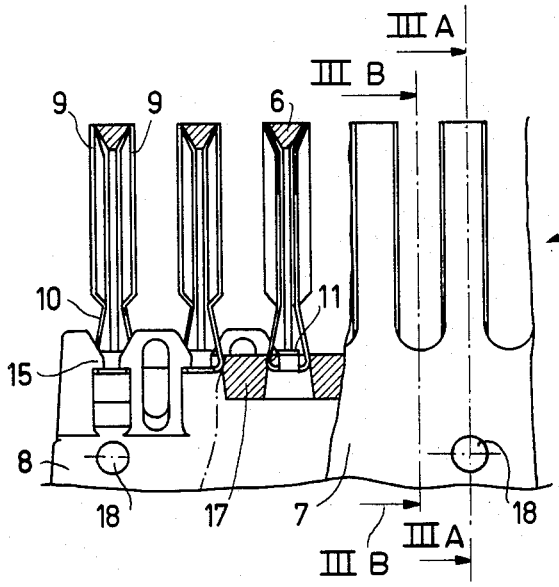
FIG. 2 is a side view partly in section, on an enlarged scale of a portion of the cutting unit of the shaving apparatus shown in FIG. 1.
Figure 3:
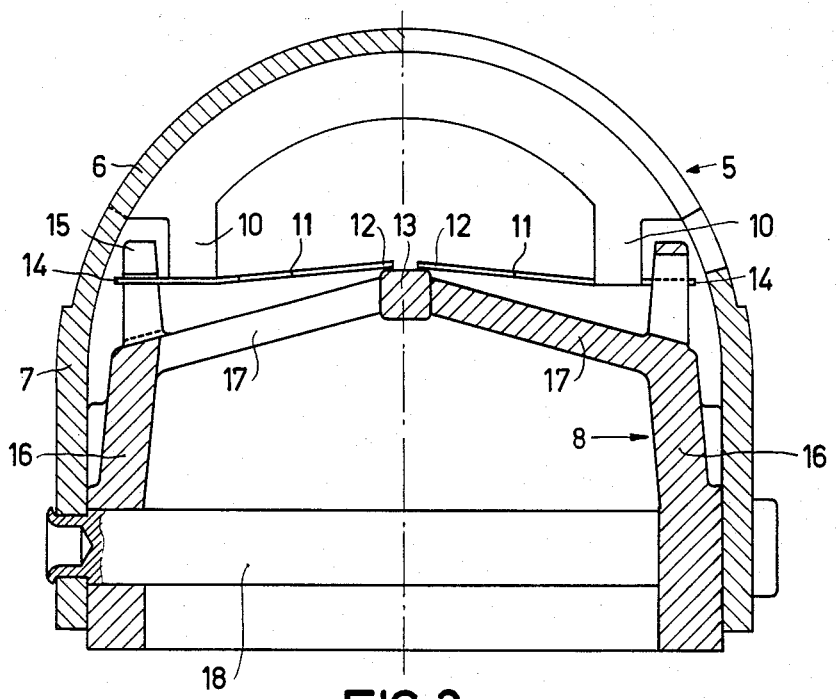
FIG. 3 is a sectional view on a further enlarged scale taken partly on the line IIIA—IIIA and partly on the line IIIB—IIIB in FIG. 2.

The cutting unit 5 is shown in detail in FIGS. 2 and 3. The arcuate cutters 6 are parts of an originally flat rectangular plate 7 which is secured to a frame 8 in arcuate form. The right-hand part of FIG. 2 shows a portion of the cutting unit in full side elevation, whilst in the left-hand part the plate 7 is broken away so that a portion of the frame 8 can be seen. The central part of FIG. 2 shows a sectional view of the cutting unit 5. The left-hand part of FIG. 3 is a sectional view taken on the line IIIA—IIIA in FIG. 2. whilst the right-hand part of FIG. 3 is a sectional view taken on the line IIIB—IIIB in FIG. 2.

The cutters 6 are of trapezoidal cross-section and are each provided with hair-pulling blades 9 on both sloping sides, which hair-pulling blades are movable relative to the associated cutters in an inward direction, i.e. in a direction substantially towards the frame 8 and back again. The two blades of each pair of hair-pulling blades 9 associated with a cutter 6 are respectively connected to a set of two resilient arms 11 by connecting members 10, the two arms 11 extending transversely of the direction of movement of the cutting unit and being arranged substantially in line with each other. The adjacent, inner ends 12 of the arms 11 are supported by a central spine 13 of the frame 8. At their other, outer ends, on the outer sides of the connecting members 10, the arms 11 form lugs 14 which engage beneath hook-shaped portions 15 of the frame 8. The hook-shaped portions 15 are disposed on the side members 16 of the frame 8. The central spine 13 is connected to the side members 16 by ribs 17. The plate 7 is secured to the frame by pins 18. Via such a pin 18 the cutting unit can be driven in a manner known per se.

Figure 4:
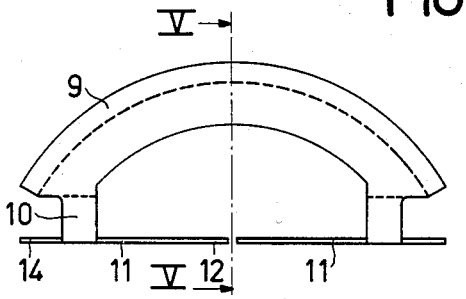
FIG. 4 shows a pair of hair-pulling blades in a side view.
Figure 5:
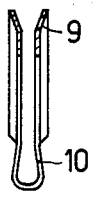
FIG. 5 is a sectional view taken on the line V—V in FIG. 4.
Figure 6:
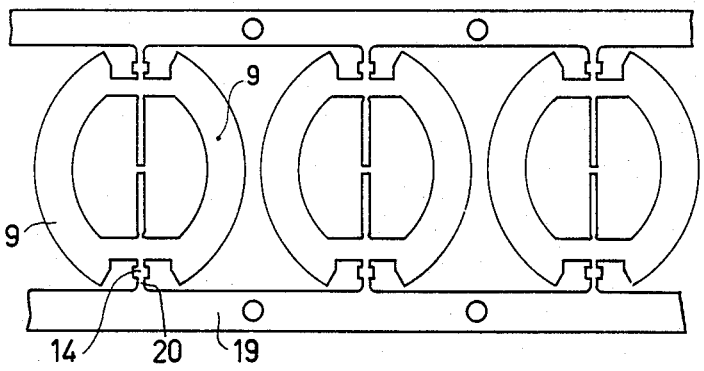
FIG. 6 shows an intermediate stage in the manufacture of a plurality of hair-pulling blades from a sheet material.

A pair of hair-pulling blades 9 is shown separately in FIGS. 4 and 5. These blades can be manufactured from a thin metal strip by a few simple operations. FIG. 6 shows an intermediate stage in a process whereby a plurality of such pairs of blades is manufactured simultaneously from a metal strip 19. In this process a plurality of pairs of hair-pulling blades 9 arranged in a row and in a flat condition is formed by a punching operation from the strip 19. Three such pairs of blades are shown in FIG. 6. After separating the lugs 14 from the edge portions of the strip 19 at the locations 20, the two blades of each pair of blades are bent up at the associated connecting members 10 to produce a pair of hair-pulling blades 9 as shown in FIGS. 4 and 5.

The embodiment described above is simple to manufacture. Mounting the hair-pulling blades is also very simple because the blades are secured in position only by the resilient arms 11 and the lugs 14 without any other fixing means.

Alternatively, the hair-pulling blades may be secured individually to the frame. It is also possible to use only one resilient element arranged centrally for example, between each hair-pulling blade and the frame.

Figure 7:
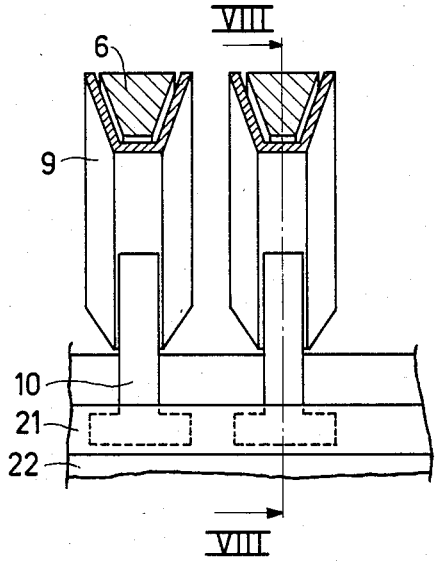
FIG. 7 is a longitudinal sectional view on an enlarged scale of a detail of a different version of the cutting unit.
Figure 8:
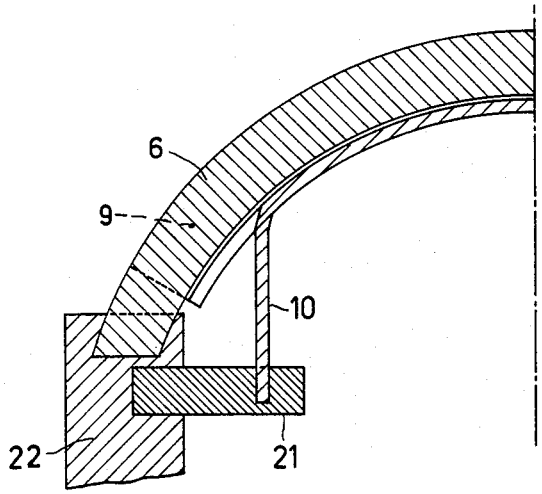
FIG. 8 is a sectional view taken on the line VIII—VIII in FIG. 7.

The embodiment shown in FIGS. 7 and 8 largely corresponds to the above-described embodiment. The connecting members 10 of the hair-pulling blades 9, however, are in this case embedded in strips 21 of an elastomeric material, such as natural rubber. The cutters 6 now form separate parts which, like the rubber strips 21, are secured to a frame 22.

As a result of the movability of the hair-pulling blades 9 relative to the cutters 6 the blades, in known manner, slightly pull up the hairs before these hairs are severed.

A hair which is pulled up in this way will generally be in contact with the edge of an aperture 4, so that as a result of frictional forces the hair tends to urge the shear plate inwards, i.e. towards the cutting unit. Therefore, it may be advantageous to make the shear plate as flexible as possible so that a hair-pulling blade, when pulling up a hair, also urges the shear plate towards the cutter associated with the blade, thereby closing a gap which may exist between the shear plate and the cutter and thus promoting an efficient cutting action by the cutter in conjuction with the shear plate.

What is claimed is:

1. A shaving apparatus comprising a shear plate with hair-entry apertures; a cutting unit associated with and reciprocatory relative to the shear plate, said cutting unit including a frame; cutters extending from said frame toward the shear plate, each cutter having a trapezoidal cross section and being in contact along its base with the shear plate; two hair-pulling blades respectively associated with and movable relative to the opposite sloping sides of each cutter, each hair-pulling blade normally being in contact at one end with the shear plate; and a pair of resilient arms connecting the respective other ends of the hair-pulling blades to the frame, said resilient arms extending transversely of the direction of movement of the cutting unit and being arranged substantially in line with each other, the ends of the arms nearer one another being supported on a central portion of the frame, the other end of each arm engaging a hook-shaped portion of the frame.

2. A shaving apparatus according to claim 1, in which each resilient arm is integral with its associated hair-pulling blade, the resilient arms and the hair-pulling blades being made of a sheet material.

* * * * *